United States Patent [19]

Connelly et al.

[11] Patent Number: 4,789,136

[45] Date of Patent: Dec. 6, 1988

[54] METHOD AND CABLE ANCHOR ASSEMBLY FOR ANCHORING PLASTIC COATED ROPE

[75] Inventors: Arthur J. Connelly, Farmington, N. Mex.; James B. Thronburg, Casper, Wyo.

[73] Assignee: Quadco, Inc., Farmington, N. Mex.

[21] Appl. No.: 186,738

[22] Filed: Apr. 25, 1988

Related U.S. Application Data

[63] Continuation of Ser. No. 924,756, Oct. 30, 1986, abandoned.

[51] Int. Cl.[4] ..... B66D 3/04

[52] U.S. Cl. ..... 254/391; 73/862.39

[58] Field of Search ..... 254/390, 391, 382, DIG. 14; 242/117, 125; 188/65.1, 65.2; 24/135 A; 73/862.39, 862.56

[56] References Cited

U.S. PATENT DOCUMENTS

| | | | |
|---|---|---|---|
| 1,644,904 | 10/1927 | West | 254/DIG. 14 |
| 2,282,685 | 5/1942 | Timbs | 24/135 A |
| 2,488,070 | 11/1949 | Spalding | 73/862.39 |
| 2,984,103 | 5/1961 | Decker | 73/862.39 |
| 3,045,480 | 7/1962 | Decker | 73/862.39 |
| 3,056,287 | 10/1962 | Gillett | 73/862.39 |
| 3,973,435 | 8/1976 | Decker et al. | 73/862.39 |
| 4,644,694 | 2/1987 | Vjihara | 254/374 X |

*Primary Examiner*—Stuart S. Levy
*Assistant Examiner*—Katherine Matecki
*Attorney, Agent, or Firm*—Paul A. Weilein

[57] ABSTRACT

A cable anchor assembly is disclosed as well as a method of using the assembly for anchoring plastic coated rope in oil well drilling derricks and the like for alternatively carrying a load on the rope and also for allowing the rope to be selectively slipped or fed through the cable anchor assembly for replacement thereof, the assembly including a snubbing drum having a circumferentially formed groove with an included angle in the range of about 130 degrees to about 165 degrees, more preferably in the range of about 150 to about 160 degrees and most preferably about 160 degrees, the groove also being formed with preferably at least two, more preferably at least three to four turns, and most preferably about three turns for engagement with the rope about the drum in order to normally support a substantial portion or more preferably the entire rope load while still permitting the rope to be selectively slipped or fed through the assembly, the clamp means including a grooved insert for engaging and clamping the rope with reduced clamping force.

25 Claims, 3 Drawing Sheets

METHOD AND CABLE ANCHOR ASSEMBLY FOR ANCHORING PLASTIC COATED ROPE

This application is a continuation, of application Ser. No. 924,756, filed Oct. 30, 1986, now abandoned.

FIELD OF THE INVENTION

The present invention relates to a cable anchor assembly and a method of use for such an assembly in anchoring plastic coated cable in oil well drilling derricks and the like while allowing the cable to be selectively slipped or fed through the cable anchor assembly, for example to replace the cable.

BACKGROUND OF THE INVENTION

A large number of designs for cable anchors have been disclosed in the prior art to form a "dead-end" coupling for securing a cable against a load carried on an oil drilling derrick or the like. The cable is commonly formed from wire and is trained or roved about a crown block and traveling block in the derrick to raise and lower the drill pipe and casing by means of the cable.

Massive loads tend to be present in deep drilling operations and it is accordingly important for the cable anchor to be able to carry them.

It is also common practice to provide a supply drum for additional cable which is slipped or fed through the cable anchor for replacing the cable roving in the derrick, usually after the cable experiences substantial wear.

A cable anchor assembly of this type was disclosed in U.S. Pat. No. 2,282,685 issued to Timbs on May 12, 1942. The cable anchor assembly of that patent included a snubbing drum and associated clamping means arranged between the derrick and the supply drum for operation in the manner generally referred to above.

U.S. Pat. No. 2,488,070 issued November 15, 1949 to Spalding further disclosed the combination of a weight indicator or load cell employed in combination with a cable anchor assembly to indicate the amount of load carried on the cable.

Still further refinements in cable anchor assemblies have been provided in the prior art. For example, U.S. Pat. No. 3,973,435 issued August 10, 1976 to Decker disclosed a cable anchor assembly including the formation of fluting or spiral grooving in a cylindrical surface of the snubbing drum with the cable being arranged within the groove.

Such cable anchor assemblies have been found to be satisfactory particularly where bare wire cable is employed with metal-to-metal engagement existing between the cable and snubbing drum and between the cable and clamp.

However, more recently, there has been a tendency to employ plastic coated cable or rope in applications other than oil well drilling for a number of reasons set forth, for example, in U.S. Pat. No. 3,824,777 issued July 23, 1974 to Riggs. That patent disclosed a stranded wire rope including a heavy viscous lubricant in its core with the outer portions of the rope or cable being impregnated or coated with plastic. This cable is commonly referred to as plastic filled valley (PFV) rope or cable and has been found to be desirable for use in drilling applications for a number of reasons. Initially, use of the internally lubricated rope or cable avoids the need for externally applying grease to the cable. Furthermore, plastic coated cables such as the PFV rope referred to above increases wear life or ton miles in drilling operations and the like while also protecting the wire from the environment, including corrosion effects, etc.

However, the use of plastic coated rope in drilling operations has been found to be incompatible with cable anchor assemblies designed for use with bare wire cable. Initially, decreased frictional engagement with the drum and with the clamp exists because of the plastic-to-wire engagement and also because of the tendency for the plastic coated rope to maintain its cylindrical shape in cross section when wound about the drum and carrying a heavy load.

A number of design variations were considered in development of the present invention in an attempt to overcome this problem and to assure that the load is secured by the cable anchor assembly while still permitting the rope to be slipped through the cable anchor assembly as desired or necessary.

For example, in some instances, it was found necessary to remove a portion of the plastic coating in order to obtain normal metal-to-metal engagement between the rope and drum for developing sufficient friction.

It has also been found that additional turns of rope could be formed about the drum for the same purpose. However, the additional turns of rope unduly increased the axial length of the drum making the cable assembly more bulky and tending to interfere with the drilling operation. At the same time, the presence of additional turns about the drum also interfered with the slipping or feeding of rope from the supply drum.

Still another expedient for overcoming this problem was the provision of increased clamping surface associated with the drum for securing the plastic coated cable. However, this was also found to be generally undesirable because of the tendency for clamps to deform the cable and prevent its proper operation as roving associated with a derrick.

Accordingly, there was found to remain a need for substantial improvements in the cable anchor assembly in order to firmly secure the rope and carry the full load, without damage to the rope, while also permitting the rope to be selectively slipped or fed through the cable anchor assembly when it was necessary for example to replace rope in the derrick.

SUMMARY OF THE INVENTION

It is therefore an object of the present invention to provide an improved cable anchor assembly and method for alternatively carrying a load in well drilling derricks and the like while also allowing the rope to be selectively slipped or fed through the cable anchor assembly.

It is a further object of the invention to provide such an improved cable anchor assembly and method of operation through the use of a snubbing drum having a spiral groove formed on a cylindrical surface of the drum for receiving the cable, the groove being formed with an included angle in the range of from about 130 to about 165 degrees, more preferably in the range of from about 150 degrees to about 160 degrees and most preferably an included angle of about 160 degrees, the groove also being formed with a number of turns for engagement with the cable about the drum, the number of turns being selected for preferably supporting a substantial portion and for more preferably supporting approximately 100 percent of the load whereby a clamp means associated with the drum normally provides a safety factor in the cable anchor assembly.

It is also an important object of the invention to form the groove with a radius approximately equal to the nominal radius or one-half the nominal diameter of rope contemplated for use with the drum. It is to be understood that sometimes the cable anchor assembly of the invention may be used with rope of a different size. However, the cable anchor assembly of the invention must be used with rope of the contemplated nominal size to realize full advantages of the invention. It is also noted that plastic coated rope of the type contemplated for use in the invention is normally somewhat oversize, typically up to about seven percent over its nominal size. With the groove radius being approximately true to its nominal size, a "pinch effect" is produced between the groove and rope to maintain desired frictional engagement therebetween.

Thus, with the cable anchor assembly being contemplated for use with plastic coated rope ranging in (nominal) diameter from about $\frac{7}{8}$–2 inches, the drum is formed with grooving of corresponding nominal size. This feature is of course combined with the included angle of the groove and number of rope turns about the drum, as discussed above and below, for establishing overall frictional engagement between the rope and drum of the cable anchor assembly.

It is a further object of the invention to provide an improved cable anchor assembly and method of operation as disclosed above wherein the groove is formed with preferably two to four turns, more preferably three to four turns and most preferably about three turns for engagement with the cable about the drum.

The precise number of turns varies of course depending upon the relative angles with which the cable enters and leaves engagement with the drum. For example, in a preferred embodiment as disclosed below, approximately one quarter turn of cable about the drum is present for this purpose. Accordingly in that embodiment, the groove is shown with about three and one quarter turns in engagement with the rope about the drum.

As is also set forth in greater detail with relation to the preferred embodiment described below, the combination of the snubbing drum and additional clamping means is employed with the cable load normally being substantially carried by frictional engagement of the cable with the drum. In such an arrangement, the clamp means serves as a safety factor for assuring proper operation of the cable anchor assembly. Furthermore, although the cable anchor assembly is adapted for use with plastic coated cable of a specified size and strength, the safety factor provided by the above combination permits safe operation of the cable anchor assembly even with plastic coated ropes of other size although use of plastic coated cable other than that of the nominal size and type particularly specified is not recommended or authorized.

It is yet another related object of the invention to provide an improved design for the clamp whereby the clamp includes an insert for engaging the plastic filled cable, the insert preferably being formed with spiral grooving to permit clamping of the cable with reduced clamping force. This in turn assures that the cable load is properly supported while further serving to prevent the possibility of damage to the cable in the cable anchor assembly.

Additional objects and advantages of the invention are made apparent in the following description having reference to the accompanying drawings.

DESCRIPTION OF THE PREFERRED EMBODIMENT

Figures 1, 3:
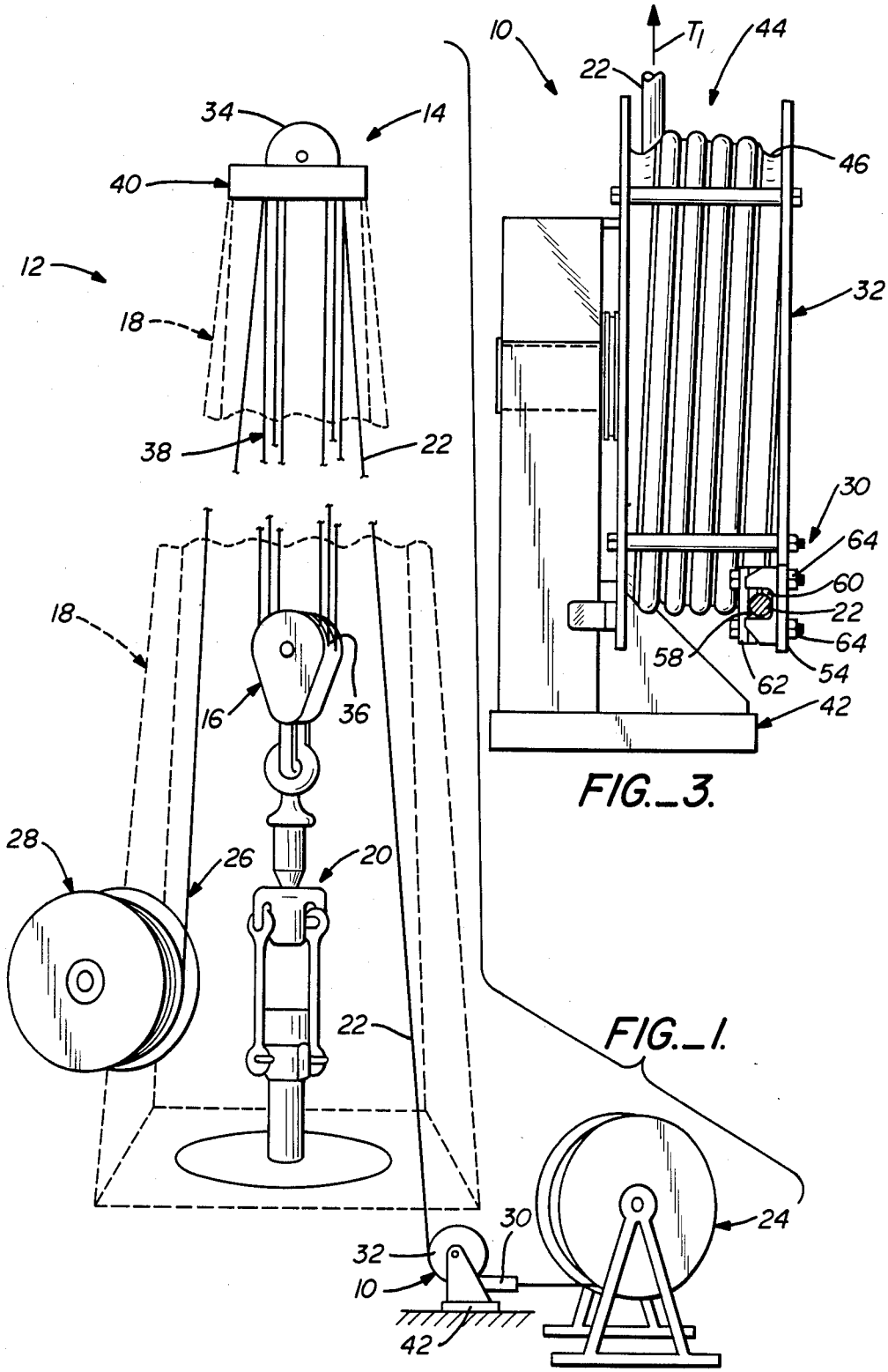
FIG. 1 is a partially schematic representation of the cable anchor assembly of the present invention associated with an oil drilling derrick.
FIG. 3 is an end view of the cable anchor assembly taken from the left side of FIG. 2.

Referring now to the drawings and particularly to FIG. 1, the invention is directed toward a cable anchor assembly generally indicated at 10 also contemplated for carrying out the method of operation of the invention. The cable anchor assembly 10 is illustrated in conjunction with an oil drilling derrick generally indicated at 12. The oil drilling derrick 12 includes a crown block 14 and a traveling block 16 as conventionally employed on a tower shown in broken lines at 18 for raising and lowering a drilling unit generally indicated at 20.

During operation of the oil drilling derrick 12, the drilling unit 20 is raised and lowered by means of cable or rope 22 operating in conjunction with the crown block 14 and traveling block 16. The rope 22 is of heavy construction in order to support the massive loads typical in drilling units such as that indicated at 20. Accordingly, the rope is susceptible to wear and must be replaced at regular intervals. For that purpose, the rope 22 on the oil drilling derrick 12 is an integral extension of rope on a supply drum 24. At the same time, the other end 26 of the rope is wound about and secured to a take-up drum 28 which stores excess rope from the derrick 12 when the traveling block 16 is raised and supplies additional rope necessary as the traveling block 16 is lowered.

To facilitate operation of the derrick 12, the rope 22 passes from the supply drum 24 through a clamp mechanism 30 and is then wound about a cylindrical snubbing drum 32 described in greater detail below. As is also described in greater detail below, the snubbing drum 32 and clamp mechanism 30 are adapted during normal operation of the derrick 12 for providing a "dead-end" anchor for the rope 22. At the same time, the clamp mechanism 30 and snubbing drum 32 are also adapted to permit the cable 22 to be slipped or fed from the supply drum 24 to the derrick when it is necessary to replace the cable on the derrick.

From the snubbing drum 32, the rope 22 passes upwardly to the crown block 14 and is then trained about sheaves 34 and 36 in the crown block and traveling block respectively to form roving generally indicated at 38 for suspending the traveling block 16 from the crown block 14.

After forming the roving 38, the rope 22 passes downwardly from the crown block 14 for engagement with the take-up drum 28.

As is conventional in such derrick units, the crown block 14 is mounted upon a structural portion 40 of the tower 18 in order to support the weight of the drilling unit 20 when it is attached to the traveling block 16.

To commence operation of the derrick 12, or when the supply drum 24 is replaced, the rope 22 is threaded in the manner described above. The clamp mechanism 30 is then engaged with the rope so that the snubbing drum 32 and clamp mechanism 30 provides the necessary dead-end anchor to support the weight of the drilling unit 20. As will be described in greater detail below, the present invention particularly contemplates design of the snubbing drum 32 so that a substantial portion of the weight or load (preferably 100%) of the drilling unit 20 carried by the rope 22 is supported by the snubbing drum 32 with the clamp mechanism 30 being available as a safety factor in the cable anchor assembly 10.

Thereafter, the drilling unit 20 is raised or lowered by rotation of the take-up drum 28 in normal operation.

Because of the massive weights involved in the drilling unit 20, the rope 22 is susceptible to wear after certain intervals of operation and is periodically replaced in what is commonly termed a "slip and cut" operation. This is accomplished by releasing the clamp mechanism 30 and slipping or feeding the rope 22 through the clamp mechanism 30 and around the snubbing drum 32. At the same time, the cable is also fed through the roving 38 to provide a new length of rope 22 between the cable anchor assembly 10 and the take-up drum 28. The worn or used rope is then removed and, with the fresh rope being secured to the take-up drum 28, operation of the derrick 12 is resumed as described above.

The present invention particularly contemplates the use of plastic coated rope or cable such as the PFV wire referred to above and described for example in the Riggs Patent referred to above. That patent is incorporated as though set out entirely herein in order to provide a complete disclosure of the plastic covered rope contemplated for the invention.

The cable anchor assembly 10 is described in greater detail below having additional reference to FIGS. 2–4. As may be best seen by combined reference to FIGS. 2–4, the snubbing drum 32 is mounted upon a base 42 and includes a cylindrical portion 44 formed with a spiral groove 46. As may be best seen in FIG. 2, the rope 22 passes horizontally from the supply drum 24 (see FIG. 1) for engagement with the clamp mechanism 30. The rope is then wound about the snubbing drum 32 in engagement with the spiral groove 46 for a selected number of turns as described in greater detail below. Thereafter, the rope 22 exits the snubbing drum in a generally vertical configuration for passage to the crown block 14 (see FIG. 1).

Because of the relative arrangement of the supply drum 24 and passage of the cable to the crown block of the derrick, the rope is wound about the snubbing drum 32 a predetermined integral number of turns plus an additional quarter-turn to permit connection with both the supply drum 24 and the derrick 12.

It is of course apparent that the arrangement of the supply drum 24 and the derrick could result in a different fractional turn on the snubbing drum. Thus, although the following description refers to a quarter turn in accordance with the embodiment of FIGS. 1–4, the integral number of complete turns about the snubbing drum is of particular importance in connection with the present invention.

A load sensor 48 is also coupled with the cable through the snubbing drum 32 for determining the instant load on the rope cable 22 in a generally conventional manner as set forth in greater detail for example in the Spalding Patent referred to above which is also incorporated herein by reference. The construction of the oil drilling derrick 12 is of course of conventional construction. At the same time, the features of the cable anchor assembly 10 discussed above are also generally in accordance with the prior art. In that regard, it is further noted that certain standards have been developed with specifications for certain features of the cable anchor assembly depending upon parameters such as the weight of the drilling unit 20. In the United States, these standards are established by the American Petroleum Institute (API).

The size or diameter of the drum 32 is selected according to a number of parameters. Generally, the maximum drum size is selected to maintain compactness of the cable anchor assembly. Its minimum diameter is particularly selected for preventing excessive bending and possible damage to the rope. Furthermore, frictional engagement between the rope and drum has been found to depend on the number of turns of rope about the drum regardless of the drum diameter.

Therefore, and in accordance with common practice, the diameter of the drum is approximately twenty times the diameter of the rope. In the cable anchor assembly of FIGS. 2–4, with the rope having a nominal diameter of 1.75 inches, the diameter of the drum 32 is approximately 31 inches.

When bright wire cable was replaced by plastic coated rope as noted above, it was found that the plastic coated rope did not have the same frictional engagement with the cable anchor assembly 10. Initially, whereas the bright wire cable relied on metal-to-metal contact with the snubbing drum, the plastic coated rope naturally involved plastic-to-metal contact. At the same time' it was found that the bright wire cable tended to "flatten out" when it was wrapped around the snubbing drum 32 under a heavy load as provided by the drilling unit 20 (see FIG. 1). The plastic coated rope, particularly as described in the above noted patent, tends to resist such deformation or flattening out even when it is a wound around the snubbing drum 32 under a heavy load. At least for these two reasons, the plastic coated rope has been found to exhibit a substantially different coefficient of friction requiring modification of the cable anchor assembly 10 in order to permit the same load of the drilling unit 20 when plastic coated rope is employed as indicated at 22 in FIG. 1. Numerous modifications were attempted during development of the present invention to adapt the cable anchor assembly 10 for use with plastic coated rope.

As one expedient, it was found that removing a portion of the plastic coating permitted metal-to-metal contact with the snubbing drum 32 so that the plastic coated rope performed generally similarly as the bright wire. However, removing the plastic coating was found to be undesirable since it destroyed the Integrity of the plastic coated rope, weakened the rope for use on the derrick and also exposed the metal strands to the environment including corrosion factors and the like.

Additional modifications included the use of multiple clamp mechanisms such as that indicated at 30 for engaging the plastic coated rope. However, these arrangements were found to be relatively cumbersome. In addition, when the clamp mechanisms were tightened against the plastic coated cable sufficiently to take-up the additional load, they tended to cause damage to the rope, thereby preventing its proper operation on the derrick.

Figure 2:
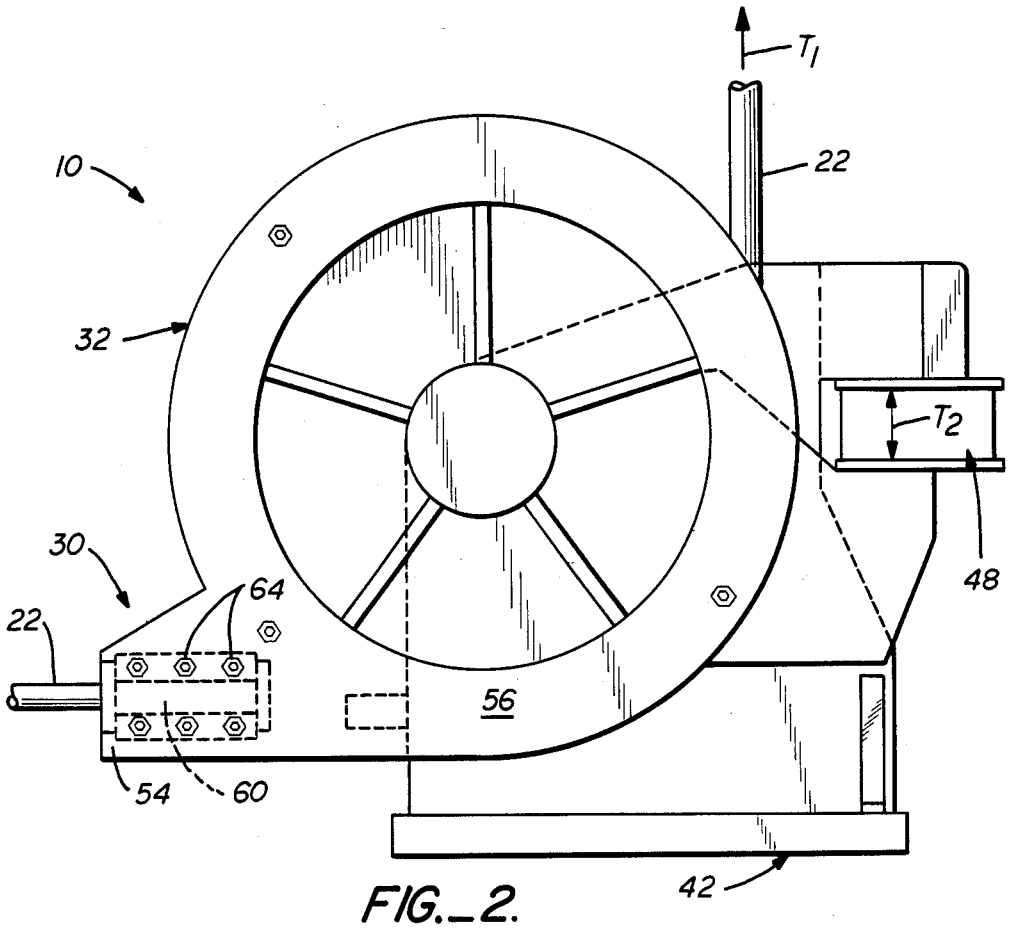
FIG. 2 is an enlarged side view in elevation of the cable anchor assembly including a snubbing drum and clamp mechanism.
Figure 4:
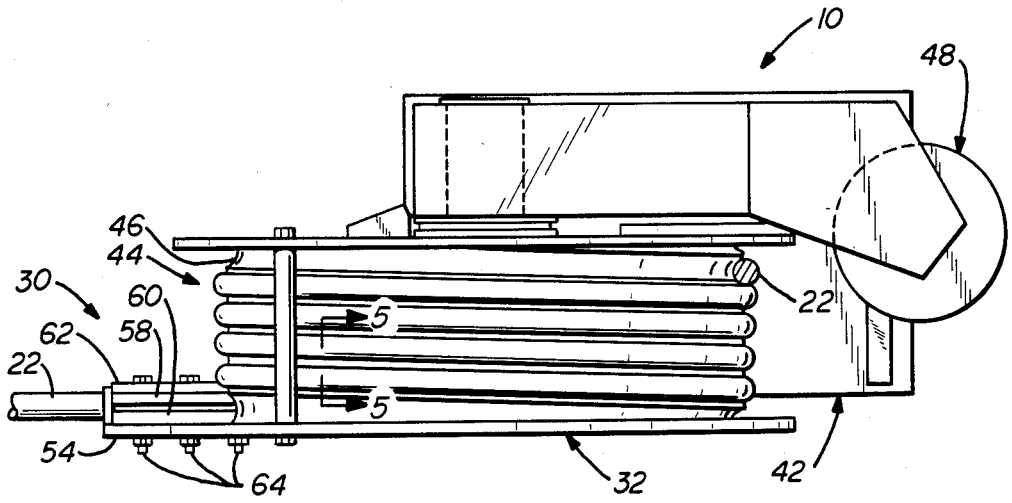
FIG. 4 is a plan view of the cable anchor assembly taken from the top of FIG. 2.

Yet another modification involved axial extension of the snubbing drum 32 to permit additional turns of rope about its cylindrical portion as indicated at 44 in FIGS. 2–4. Obviously, if sufficient additional turns of rope about the snubbing drum were employed, the load of the drilling unit could be supported. However, the provision of additional grooving in the snubbing drum unduly increased its axial length making the cable anchor assembly 10 generally cumbersome and difficult to handle. At the same time, as additional turns of rope were employed about the drum, it also became more difficult to slip or feed the rope about the drum during cable replacement as described above.

These difficulties in substituting plastic coated rope for the earlier bright wire cable are described in detail in order to permit a more complete understanding of the invention which is set forth immediately below as a means for facilitating use of the cable anchor assembly 10 with plastic coated rope while maintaining the relatively compact configuration for the cable anchor assembly 10, particularly the snubbing drum 32, and also assuring the capability of slipping or feeding the rope through the cable anchor assembly 10 as necessary for cable replacement. At the same time, the present invention also contemplates the provision of a safety factor within the cable anchor assembly 10 for further enhancing its operation in conjunction with oil drilling derricks, such as that indicated at 12 in FIG. 1, and the like.

Figure 5:
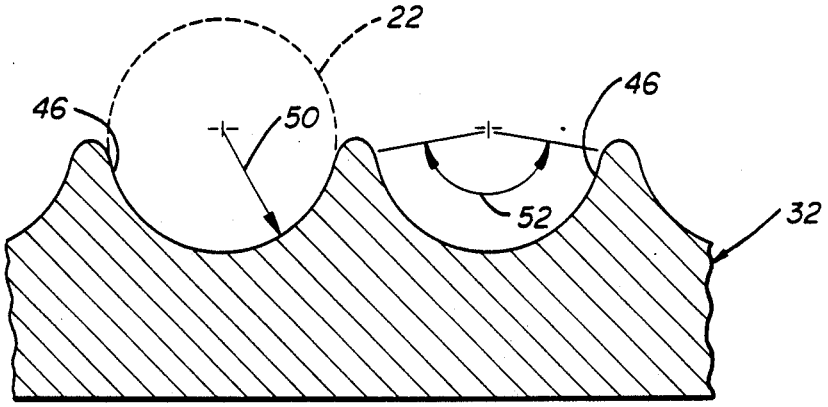
FIG. 5 is an enlarged fragmentary view taken along section line 5—5 of FIG. 4 to better illustrate the configuration of a spiral groove in the snubbing drum with a cross-section of the plastic covered rope shown in broken lines.
Figure 6:
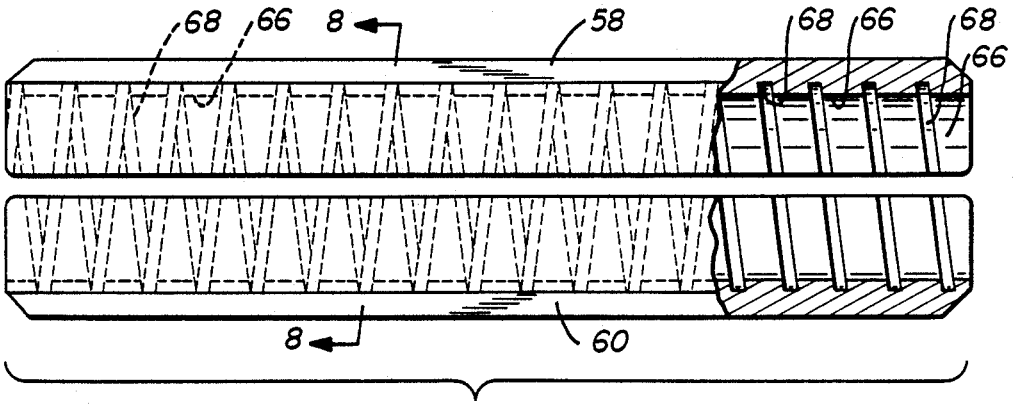
FIG. 6 is a side view of a pair of inserts illustrated in opposed and spaced apart relation for arrangement with the clamp mechanism of FIGS. 2 and 3.
Figure 7:
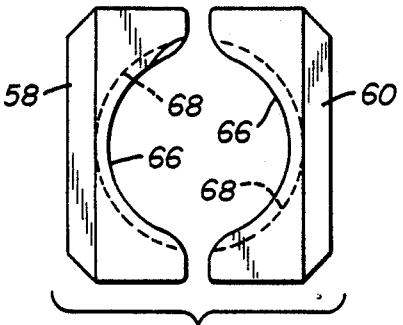
FIG. 7 is an end view of the two clamp inserts taken from the left end of FIG. 6 and rotated 90°.
Figure 8:
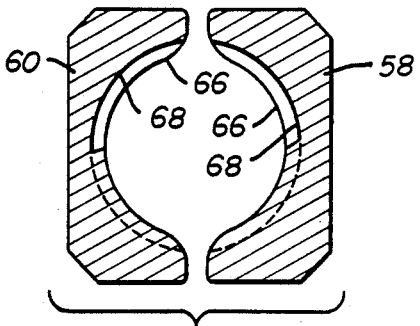
FIG. 8 is a view, with parts in section, taken along section line 8—8 of FIG. 6 rotated 90°.

Substantial testing developed the following parameters for the present invention in connection with the snubbing drum 32. Initially, the size of the groove 46, particularly its radius and included angle were found to be of critical importance. As is best illustrated in FIG. 5, the groove 46 is formed with a uniform radius of curvature along its length as indicated at 50. The included angle of the groove is indicated at 52.

The radius 50 of the groove 46 is of course related to the particular size of plastic coated rope contemplated for use with the cable anchor assembly. Generally, it is necessary for the radius 50 of the groove 46 to be selected in order to provide frictional engagement between the surface of the groove 46 and an extended surface portion of the plastic coated rope. At the same time, it is necessary that the radius 50 of the groove 46 is selected so that the rope can be slipped or fed about the snubbing drum 32 during replacement as described above.

As noted above, the groove is preferably the same size as the "nominal" size of the rope 22 in order to produce a "pinch effect" between the rope and groove. However, as is indicated by the following test data, some variance is possible between groove size and nominal rope diameter although not recommended for optimum performance of the invention.

At the same time, it has been found that the included angle 52 for the groove 46 is particularly important for insuring proper frictional engagement with the plastic coated rope and at the same time allowing the plastic coated rope to be slipped or fed through the groove 46 during replacement.

The number of turns formed by the groove 46 about the cylindrical surface of the snubbing drum 32 is of related importance in this regard. As noted above, it is generally desirable to avoid excessive numbers of turns in order to allow the snubbing drum 32 to be as compact as possible and also to still allow the plastic coated cable to be slipped through the entire length of the groove 46.

In accordance with drum sizing, it has been determined in accordance with preferably about two to four turns, more preferably three to four turns and most preferably about three turns of the groove 46 are necessary for engagement with the rope about the circumference of the snubbing drum 32. Here again, it is noted that the number of turns referred to in this regard are defined to include that portion of the groove 46 which is in actual contact with the rope 22. Also, it is again noted that a fractional turn, for example one quarter turn as illustrated in FIG. 2 is necessary to accommodate for the direction in which the cable 22 approaches the snubbing drum 32 from the supply drum 24 and the direction in which the cable 22 exits the snubbing drum 32 toward the derrick (also see FIG. 1).

In any event, it has been found in accordance with the present invention that, in the embodiment of FIGS. 1–4, at least three turns, or three and one quarter turns are most preferred to assure proper frictional engagement between the groove 46 and the rope 22 while still allowing the rope 22 to be slipped or fed through the groove for replacement.

At the same time, it was found necessary to form the included angle 52 within the range of from about 130 degrees to about 165 degrees. Preferably, frictional engagement between the groove 46 and rope 22 is best maintained if the included angle 52 is maintained within the range of about 150 degrees to about 160 degrees and most preferably at about 160 degrees.

With the preceding values being established for the snubbing drum 32 and the spiral groove 46, the groove 46 is selected (preferably) for supporting a substantial portion (more preferably 100 percent) of the load on the rope 22. As will be made more apparent in the test results set forth below, the meeting of that goal depends upon various factors in the selection of the plastic filled cable and the particular design of the snubbing drum 32 and clamp mechanism 30.

The specific construction of the snubbing drum 32 and clamp mechanism 30 is illustrated in FIGS. 2–4 and 6–8 and is described in greater detail below.

The snubbing drum 32 is fabricated to withstand contemplated loads with the cylindrical portion 44 being mounted on the base 42 generally in accordance with prior art constructions also described in greater detail within the references noted above. Accordingly, the patents referenced above are incorporated herein as though set forth in their entirety to assure a more complete understanding of the invention.

With the cylindrical drum portion 44 being arranged on the base 42 for receiving the plastic coated rope 22 in its groove 46, the load sensor or test cell 48 is also conventionally interconnected between the cylindrical drum portion 44 and the base 42 for measuring the instantaneous load on the cable. Here again, the interconnection and function of the load sensor 48 in the present invention is similar to that described in the references noted above.

The clamp mechanism 30 includes a housing portion 54 which is an integral portion of structural fabrication 56 for the snubbing drum 32. Inserts 58 and 60 (also see FIGS. 6–8) are arranged within the clamp mechanism 30 for directly engaging the cable 22 and are urged into clamping engagement with the cable 22 by means of a clamping plate 62. The housing portion 54 and clamping plate 62 are configured for receiving the inserts while also being interconnected by means of bolts 64 which are rotated under measured torque loads for causing the inserts 58 and 60 to enter into clamping engagement with the cable 22.

The clamp mechanism 30 is also sized relative to the selected plastic coated cable being used in a particular application. In particular, the inserts 58 and 60 are formed with cylindrical inner surfaces 66 (see FIGS. 6–8) which generally conform with the diameter of the selected plastic coated cable. In addition, the cylindrical inner surfaces 66 are formed with grooves 68 which provide for better clamping engagement of the inserts 58 and 60 with the plastic coated cable.

For example, with the cable having a nominal diameter of about one and one-half inches, the grooving 68 is preferably formed with a depth of about one sixteenth inch and a width of about one-eighth inch. The grooving 68 is also preferably machined in the manner of a square bolt thread a may be best seen in FIG. 6, with a pitch of about four threads per inch.

The major advantage of the clamp mechanism 30 over prior art clamp mechanisms resides in the grooving 68 which permits decreased torquing of the bolts 64 while still maintaining clamping engagement of the inserts 58 and 60 with the plastic coated rope. Here again, it is noted that the clamp mechanism 30 is preferably present in the cable anchor assembly 10 to provide a safety factor with the groove 46 carrying substantially the entire rope load. However, in different applications, it is of course contemplated that additional loading may be encountered and the clamp mechanism 30 is designed to resist that additional load.

The construction of the cable anchor assembly 10 and its method of operation for anchoring plastic coated rope is believed to be fully apparent from the preceding description. However, a number of tests for different combinations of cable anchor assemblies and plastic coated rope are set forth below to facilitate a more complete understanding of the invention.

In the following tests, plastic coated rope was employed having a nominal diameter of either one and one half inches or one and three-fourths inches. The plastic coated rope was obtained from Greening Donald under the trade designation "REGULAR LAY 6X26 PFV". Results for the various tests are set forth below.

TEST I

In this test, a cable anchor assembly constructed as illustrated in FIGS. 2–4 was employed with plastic coated rope having a nominal diameter of one and one half inches. The diameter of the snubbing drum 32 was 31 inches. A deadline load was applied to the cable 22 as indicated at $T_1$ in FIG. 2. In the clamp mechanism 30, the inserts 58 and 60 were approximately nine inches in length with six clamping bolts being employed as indicated at 64 in FIG. 2. The bolts 64 were standard $\frac{7}{8}$ inch machine bolts.

With the plastic coated rope being a nominal one and one half inch diameter, the groove 46 in the snubbing drum was formed with four and one quarter turns in engagement with the cable 22 as illustrated in FIG. 2. The groove 46 also had a uniform diameter of one and three quarter inches (a radius of seven eighths inches) with an included angle of 160 degrees.

The plastic coated rope was installed as illustrated in FIGS. 1 and 2 with the bolts 64 being tightened to a predetermined torque level. The deadline load $T_1$ was then varied with readings being taken of the load cell load $T_2$ after intervals of one minute, two minutes, three minutes, four minutes, etc. These time intervals were selected because when loading at $T_1$ occurs, it takes a period of time for partial loading to occur at $T_2$ due to the coefficient of friction between the PFV wire rope and the grooves in the anchor. A four to five minute time period was determined to be sufficient during testing so maximum pull at $T_2$ could be recorded.

Results for this test were as follows:

| | Sensor Load $T_2$ (lbs) | | | |
|---|---|---|---|---|
| Deadline Load $T_1$ (lbs) | 1 Min. | 2 Min. | 3 Min. | 4 Min. |
| 20,000 | 300 | 300 | 300 | — |
| 40,000 | — | — | — | — |
| 60,000 | 900 | 1100 | 1150 | 1200 |
| 80,000 | 2200 | 2300 | 2400 | 2450 |
| 100,000 | 3600 | 4000 | 4200 | 4300 |
| 120,000 | 5100 | 5800 | 6100 | 6300 |
| 130,000 | 6600 | 7050 | 7350 | 7600 |

The dashes appearing in the table indicate no further loading after the initial time period was recorded.

TEST II

The conditions of TEST I were repeated except that a film of 10 W motor oil was applied to the surface of the snubbing drum 32 and the spiral groove 46 to simulate conditions often encountered in the field.

Results from this test were as follows:

| Deadline Load | Sensor Load $T_2$ (lbs) | | | | |
|---|---|---|---|---|---|
| $T_1$ (lbs) | 1 Min. | 2 Min. | 3 Min. | 4 Min. | 5 Min. |
| 130,000* | 17,200 | 17,300 | 17,375 | 17,400 | — |
| 130,000* | 17,900 | 18,000 | 18,000 | 18,000 | — |
| 130,000* | 12,300 | 12,600 | 12,650 | 12,700 | — |
| 150,000 | — | — | — | — | 13,500 |

*$T_1$ load of 130,000 lbs repeated.

TEST III

The conditions of Test I were again repeated except that plastic coated rope having a nominal diameter of one and three-fourths inches was employed. The snuffing drum 32 as dry and generally free from oil.

In this test, the plastic coated rope was "one and three-fourths inch REGULAR LAY 6X19 PFV".

The results of this test were as follows:

| Deadline Load | Sensor Load $T_2$ (lbs) | | | | |
|---|---|---|---|---|---|
| $T_1$ (lbs) | 1 Min. | 2 Min. | 3 Min. | 4 Min. | 5 Min. |
| 20,000 | 0.0 | 0.0 | 0.0 | 0.0 | 0.0 |
| 40,000 | 0.0 | 0.0 | 0.0 | 0.0 | 0.0 |
| 60,000 | 0.0 | 0.0 | 0.0 | 0.0 | 0.0 |
| 80,000 | 0.0 | 0.0 | 0.0 | 0.0 | 0.0 |
| 100,000 | 0.0 | 0.0 | 0.0 | 0.0 | 0.0 |
| 120,000 | 0.0 | 0.0 | 0.0 | 0.0 | 0.0 |
| 130,000 | 0.0 | 0.0 | 0.0 | 0.0 | 0.0 |

-continued

| Deadline Load $T_1$ (lbs) | Sensor Load $T_2$ (lbs) 1 Min. | 2 Min. | 3 Min. | 4 Min. | 5 Min. |
|---|---|---|---|---|---|
| 140,000 | 0.0 | 0.0 | 0.0 | 0.0 | 0.0 |

TEST IV

The conditions of Test III were again repeated except that only one and one and one-fourth turns of cable were employed about the snubbing drum 32. In this test, the plastic coated cable was identified as "one and three-fourths inch REGULAR LAY 6X39 PFV".

The results for this test were as follows:

| Deadline Load $T_1$ (lbs) | Sensor Load $T_2$ (lbs) 1 Min. | 2 Min. | 3 Min. | 4 Min. |
|---|---|---|---|---|
| 20,000 | 1150 | 1150 | 1150 | — |
| 30,000 | 1600 | 1650 | 1700 | — |
| 40,000 | 4100 | 4150 | 4200 | — |
| 50,000 | 7000 | 7100 | 7150 | — |
| 60,000 | 10000 | 10100 | 10150 | — |
| 70,000 | 11400 | 11200 | 11000 | — |

Comment: The cable slipped with $T_1$ equal to 70,000 lbs.

TEST V

The conditions of Test IV were repeated exactly except that the bolts 64 were retorqued to 300 lbs.

The results of this test are as follows:

| Deadline Load $T_1$ (lbs) | Sensor Load $T_2$ (lbs) 1 Min. | 2 Min. | 3 Min. | 4 Min. |
|---|---|---|---|---|
| 50,000 | 9300 | 9400 | 9500 | — |
| 60,000 | 12100 | 12400 | 12550 | — |
| 70,000 | 15100 | 15500 | 15700 | — |

Comment: No slip occurred with $T_1$ equal to 70,000 lbs.

TEST VI

The conditions of Test IV were again repeated but with two and one-fourth wraps of cable about the snubbing drum 32. The drum was again dry and free from oil.

Results for this test were as follows:

| Deadline Load $T_1$ (lbs) | Sensor Load $T_2$ (lbs) 1 Min. | 2 Min. | 3 Min. | 4 Min. |
|---|---|---|---|---|
| 30,000 | 0.0 | 0.0 | 0.0 | 0.0 |
| 40,000 | 250 | 250 | 250 | — |
| 50,000 | 550 | 650 | 700 | — |
| 60,000 | 1100 | 1200 | 1300 | — |
| 70,000 | 1700 | 1900 | 2000 | — |

TEST VII

The conditions of Test I were again repeated except that only one and one quarter wraps of cable were employed on the snubbing drum 32. As in Test I, the surface of the drum was dry and free from oil.

The results of this test were as follows:

| Deadline Load $T_1$ (lbs) | Sensor Load $T_2$ (lbs) 1 Min. | 2 Min. | 3 Min. | 4 Min. |
|---|---|---|---|---|
| 10,000 | 450 | — | — | — |
| 17,000 | 450 | — | — | — |

-continued

| Deadline Load $T_1$ (lbs) | Sensor Load $T_2$ (lbs) 1 Min. | 2 Min. | 3 Min. | 4 Min. |
|---|---|---|---|---|
| 20,000 | 4100 | — | — | — |
| 0–20,000* | 4200 | — | — | — |
| 25,000 | 7300 | — | — | — |
| 30,000 | 10000 | — | — | — |
| 35,000 | 13100 | 13300 | — | — |
| 40,000 | 15600 | 15800 | — | — |

*The 20,000 lb test was repeated with the load applied very rapidly to simulate shock loading that may occur in normal drilling operations.

TEST VIII

The conditions of Test I were again repeated except with two and one-fourth wraps of cable around the snubbing drum 32.

The results of this test were as follows:

| Deadline Load $T_1$ (lbs) | Sensor Load $T_2$ (lbs) 1 Min. | 2 Min. | 3 Min. | 4 Min. |
|---|---|---|---|---|
| 11,000 | 500 | — | — | — |
| 12,000 | 500 | — | — | — |
| 20,000 | 1000 | — | — | — |
| 25,000 | 2300 | 2400 | — | — |
| 30,000 | 4000 | — | — | — |
| 35,000 | 5500 | — | — | — |
| 40,000 | 7000 | — | — | — |
| 0–40,000* | 8600 | — | — | — |

*The 40,000 lb test was repeated with the load applied very rapidly to simulate shock loading that may occur in normal drilling operations.

An additional series of tests was conducted to determine the optimum range for the included angle of the groove and also to determine the preferred number of turns of rope engaged about the drum 32. In addition, these tests included "slip and cut" testing to determine the ability of slipping or feeding additional rope through the cable anchor assembly for replacement in the derrick as described above.

in all of the following Tests IX–XXVII (as in the previous tests above), plastic coated rope identified as PFV REGULAR LAY 6X39 wire rope manufactured by Greening Donald. In Tests IX–XVII, the plastic coated rope had a nominal diameter of one and three quarter inches. In each of these tests, the drum had a diameter of 32 inches. The diameter for the groove was 1 and ¾ inches. Accordingly, in Tests IX–XVII, the only variables were the included angle of the groove and the number of turns of plastic filled rope about the drum. Accordingly, these two variables are initially set forth in each of the following tests followed by dynamic load test results and comments relating to certain of the tests.

TEST IX

Included Groove Angle—165 degrees

Number of Rope Turns—Four and One-fourth

Results for this test were as follows:

| Deadline Load $T_1$ (lbs) | Sensor Load $T_2$ (lbs) 1 Min. | 2 Min. | 3 Min. | 4 Min. |
|---|---|---|---|---|
| 130,000 | 0 | — | — | — |

Comment: No load at $T_2$ was observed after five minutes. In Test IX as in all of the other tests set forth herein, the included angle for the groove is determined as the approximate included angle along the length of the groove about the circumference of the snubbing drum.

Test X

Included Groove Angle—165 degrees
Number of Rope Turns—Three and One-fourth
Results for this test were as follows:

| Deadline Load $T_1$ (lbs) | Sensor Load $T_2$ (lbs) 1 Min. | 2 Min. | 3 Min. | 4 Min. |
|---|---|---|---|---|
| 130,000 | 0 | — | — | — |

Comment: No load at $T_2$ was observed after five minutes.

TEST XI

Included Grove Angle—165 degrees
Number of Rope Turns—Two and One-fourth
Results of this test were as follows:

| Deadline Load $T_1$ (lbs) | Sensor Load $T_2$ (lbs) 1 Min. | 2 Min. | 3 Min. | 4 Min. |
|---|---|---|---|---|
| 50,000 | 200 | — | — | — |
| 60,000 | 300 | 350 | — | — |
| 70,000 | 900 | 900 | — | — |
| 80,000 | 1300 | 1300 | — | — |
| 90,000 | 1800 | 1825 | — | — |
| 100,000 | 2500 | 2600 | — | — |
| 110,000 | 3100 | 3200 | — | — |
| 120,000 | 3700 | 3850 | — | — |
| 130,000 | 4400 | 4525 | — | — |

TEST XII

Included Groove Angle—158 degrees
Number of Rope Turns—Three and One-fourth
Results of this test were as follows:

| Deadline Load $T_1$ (lbs) | Sensor Load $T_2$ (lbs) 1 Min. | 2 Min. | 3 Min. | 4 Min. |
|---|---|---|---|---|
| 130,000 | 0 | — | — | — |

Comment: No load at $T_2$ was observed after five minutes.

TEST XIII

Included Groove Angle—160 degrees
Number of Rope Turns—Two and One-fourth
Results of this test were as follows:

| Deadline Load $T_1$ (lbs) | Sensor Load $T_2$ (lbs) 1 Min. | 2 Min. | 3 Min. | 4 Min. |
|---|---|---|---|---|
| 50,000 | 100 | 100 | — | — |
| 60,000 | 125 | 150 | — | — |
| 70,000 | 250 | 300 | — | — |
| 80,000 | 450 | 500 | — | — |
| 90,000 | 700 | 800 | — | — |
| 100,000 | 1500 | 1700 | — | — |
| 110,000 | 2100 | 2450 | — | — |
| 120,000 | 3100 | 3300 | — | — |
| 130,000 | 3900 | 4100 | 4800 | — |

TEST XIV

Included Groove Angle—160 degrees
Number of Rope Turns—Three and One-fourth
Results of this test were as follows:

| Deadline Load $T_1$ (lbs) | Sensor Load $T_2$ (lbs) 1 Min. | 2 Min. | 3 Min. | 4 Min. |
|---|---|---|---|---|
| 50,000 | 0 | 0 | — | — |
| 70,000 | 0 | 0 | — | — |
| 90,000 | 0 | — | — | — |
| 100,000 | 0 | — | — | — |
| 110,000 | 0 | — | — | — |
| 120,000 | 100 | — | — | — |
| 130,000 | 100 | — | — | — |

Comment: In Tests IX-XI, where the included angle was 165 degrees, it was relatively difficult to advance to slip or feed the plastic filled rope. By contrast, in this test as in Test XII and all other successive tests with an included angle of about 160° or less, it was relatively easy to slip or feed the plastic covered rope in a "slip and cut" operation.

TEST XV

Included Groove Angle—154 degrees
Number of Rope Turns—Two and One-fourth
Results of this test were as follows:

| Deadline Load $T_1$ (lbs) | Sensor Load $T_2$ (lbs) 1 Min. | 2 Min. | 3 Min. | 4 Min. | 5 Min. |
|---|---|---|---|---|---|
| 40,000 | 150 | 200 | — | — | — |
| 50,000 | 225 | 275 | — | — | — |
| 60,000 | 400 | 400 | — | — | — |
| 70,000 | 750 | 1000 | — | — | — |
| 80,000 | 1600 | 1900 | — | — | — |
| 90,000 | 2800 | 3100 | — | — | — |
| 100,000 | 3800 | 4100 | — | — | — |
| 110,000 | 4800 | 5000 | — | — | — |
| 120,000 | 5600 | 5700 | — | — | — |
| 130,000 | 6200 | 6400 | 6500 | 6600 | 6700 |

TEST XVI

Included Groove Angle—150 degrees
Number of Rope Turns—Three and One-fourth
Results of this test were as follows:

| Deadline Load $T_1$ (lbs) | Sensor Load $T_2$ (lbs) 1 Min. | 2 Min. | 3 Min. | 4 Min. |
|---|---|---|---|---|
| 50,000 | 0 | 0 | — | — |
| 60,000 | 0 | 0 | — | — |
| 70,000 | 0 | 0 | — | — |
| 80,000 | 0 | 0 | — | — |
| 90,000 | 0 | 0 | — | — |
| 100,000 | 50 | 100 | — | — |
| 110,000 | 100 | 150 | — | — |
| 120,000 | 200 | 225 | — | — |
| 130,000 | 300 | 300 | — | — |

In the test 0–130,000, the 130,000 lb. load was applied very rapidly to simulate shock loading that may occur in normal drilling operations.

TEST XVII

Included Groove Angle—150 degrees
Number of Rope Turns—Two and One-fourth
Results of this test were as follows:

| Deadline Load $T_1$ (lbs) | Sensor Load $T_2$ (lbs) 1 Min. | 2 Min. | 3 Min. | 4 Min. |
|---|---|---|---|---|
| 40,000 | 50 | 75 | — | — |
| 50,000 | 100 | 175 | — | — |
| 60,000 | 300 | 350 | — | — |
| 70,000 | 625 | 850 | — | — |
| 80,000 | 1250 | 1500 | — | — |
| 90,000 | 2000 | 2300 | — | — |
| 100,000 | 3000 | 3300 | — | — |
| 110,000 | 4000 | 4200 | — | — |

-continued

| Deadline Load $T_1$ (lbs) | Sensor Load $T_2$ (lbs) 1 Min. | 2 Min. | 3 Min. | 4 Min. |
|---|---|---|---|---|
| 120,000 | 4800 | 4800 | — | — |
| 130,000 | 5700 | 6000 | 6100 | 6200 |
| 0–130,000 | 7000 | 7100 | 7400 | — |

TEST XVIII

Included Groove Angle—145 degrees
Number of Rope Turns—Three and One-fourth
Results of this test were as follows:

| Deadline Load $T_1$ (lbs) | Sensor Load $T_2$ (lbs) 1 Min. | 2 Min. | 3 Min. | 4 Min. |
|---|---|---|---|---|
| 40,000 | 0 | 0 | — | — |
| 50,000 | 0 | 0 | — | — |
| 60,000 | 0 | 0 | — | — |
| 70,000 | 50 | 100 | — | — |
| 80,000 | 100 | 100 | — | — |
| 90,000 | 150 | 150 | — | — |
| 100,000 | 150 | 175 | — | — |
| 110,000 | 200 | 250 | — | — |
| 120,000 | 350 | 400 | — | — |
| 130,000 | 500 | 625 | 700 | 800 |

TEST XIX

Included Groove Angle—145 degrees
Number of Rope Turns—Two and One-fourth
Results of this test were as follows:

| Deadline Load $T_1$ (lbs) | Sensor Load $T_2$ (lbs) 1 Min. | 2 Min. | 3 Min. | 4 Min. | 5 Min. |
|---|---|---|---|---|---|
| 30,000 | 0 | 0 | — | — | — |
| 40,000 | 150 | 175 | — | — | — |
| 50,000 | 400 | 550 | — | — | — |
| 60,000 | 900 | 1000 | — | — | — |
| 70,000 | 1400 | 1500 | — | — | — |
| 80,000 | 2000 | 2200 | — | — | — |
| 90,000 | 3000 | 3200 | — | — | — |
| 100,000 | 3900 | 4150 | — | — | — |
| 110,000 | 4900 | 5150 | — | — | — |
| 120,000 | 5200 | 6050 | — | — | — |
| 130,000 | 6750 | 7100 | 7300 | 7500 | 7600 |

TEST XX

Included Groove Angle—141 degrees
Number of Rope Turns—Three and One-fourth
Results of this test were as follows:

| Deadline Load $T_1$ (lbs) | Sensor Load $T_2$ (lbs) 1 Min. | 2 Min. | 3 Min. | 4 Min. |
|---|---|---|---|---|
| 40,000 | 0 | 0 | — | — |
| 50,000 | 0 | 0 | — | — |
| 60,000 | 25 | 25 | — | — |
| 70,000 | 25 | 25 | — | — |
| 80,000 | 375 | 375 | — | — |
| 90,000 | 375 | 375 | — | — |
| 100,000 | 375 | 375 | — | — |
| 110,000 | 400 | 400 | — | — |
| 120,000 | 450 | 475 | — | — |
| 130,000 | 500 | 550 | 600 | 625 |
| 0–130,000 | 600 | — | — | — |

TEST XXI

Included Groove Angle—141 degrees
Number of Rope Turns—Two and One-fourth
Results of this test were as follows:

| Deadline Load $T_1$ (lbs) | Sensor Load $T_2$ (lbs) 1 Min. | 2 Min. | 3 Min. | 4 Min. | 5 Min. |
|---|---|---|---|---|---|
| 30,000 | 0 | 0 | — | — | — |
| 40,000 | 100 | 125 | — | — | — |
| 50,000 | 250 | 300 | — | — | — |
| 60,000 | 500 | 600 | — | — | — |
| 70,000 | 1000 | 1100 | — | — | — |
| 80,000 | 1650 | 1950 | — | — | — |
| 90,000 | 2500 | 2800 | — | — | — |
| 100,000 | 3550 | 3800 | — | — | — |
| 110,000 | 4400 | 4600 | — | — | — |
| 120,000 | 5400 | 5700 | — | — | — |
| 130,000 | 6500 | 6800 | 7000 | 7100 | 7200 |
| 0–130,000 | — | 8000 | — | — | — |

TEST XXII

Included Groove Angle—136 degrees
Number of Rope Turns—Three and One-fourth
Results of this test were as follows:

| Deadline Load $T_1$ (lbs) | Sensor Load $T_2$ (lbs) 1 Min. | 2 Min. | 3 Min. | 4 Min. | 5 Min. |
|---|---|---|---|---|---|
| 40,000 | 0 | 0 | — | — | — |
| 50,000 | 0 | 0 | — | — | — |
| 60,000 | 25 | 25 | — | — | — |
| 70,000 | 75 | 100 | — | — | — |
| 80,000 | 125 | 125 | — | — | — |
| 90,000 | 150 | 150 | — | — | — |
| 100,000 | 475 | 475 | — | — | — |
| 110,000 | 475 | 500 | — | — | — |
| 120,000 | 650 | 700 | — | — | — |
| 130,000 | 750 | 800 | 875 | 900 | 925 |
| 0–130,000 | 1000 | — | — | — | — |

TEST XXIII

Included Groove Angle—136 degrees
Number of Rope Turns—Two and One-fourth
Results of this test were as follows:

| Deadline Load $T_1$ (lbs) | Sensor Load $T_2$ (lbs) 1 Min. | 2 Min. | 3 Min. | 4 Min. | 5 Min. |
|---|---|---|---|---|---|
| 30,000 | 225 | 225 | — | — | — |
| 40,000 | 350 | 400 | — | — | — |
| 50,000 | 650 | 750 | — | — | — |
| 60,000 | 1200 | 1300 | — | — | — |
| 70,000 | 2400 | 2600 | — | — | — |
| 80,000 | 3300 | 3400 | — | — | — |
| 90,000 | 4200 | 4400 | — | — | — |
| 100,000 | 5200 | 5400 | — | — | — |
| 110,000 | 6200 | 6450 | — | — | — |
| 120,000 | 7300 | 7600 | — | — | — |
| 130,000 | 8400 | 8600 | 8800 | 9000 | 9100 |
| 0–130,000 | — | 10000 | — | — | — |

TEST XXIV

Included Groove Angle—132 degrees
Number of Rope Turns—Three and One-fourth
Results of this test were as follows:

| Deadline Load $T_1$ (lbs) | Sensor Load $T_2$ (lbs) 1 Min. | 2 Min. | 3 Min. | 4 Min. |
|---|---|---|---|---|
| 40,000 | 0.0 | 0 | — | — |
| 50,000 | 0.0 | 0.0 | — | — |
| 60,000 | 25 | 50 | — | — |
| 70,000 | 100 | 100 | — | — |
| 80,000 | 125 | 125 | — | — |
| 90,000 | 125 | 125 | — | — |
| 100,000 | 150 | 200 | — | — |
| 110,000 | 225 | 225 | — | — |
| 120,000 | 275 | 325 | — | — |
| 130,000 | 425 | 575 | 700 | 800 |
| 0–130,000 | 925 | 1050 | — | — |

TEST XXV

Included Groove Angle—132 degrees
Number of Rope Turns—Two and One-fourth
Results of this test were as follows:

| Deadline Load $T_1$ (lbs) | Sensor Load $T_2$ (lbs) 1 Min. | 2 Min. | 3 Min. | 4 Min. | 5 Min. |
|---|---|---|---|---|---|
| 30,000 | 300 | 300 | — | — | — |
| 40,000 | 425 | 450 | — | — | — |
| 50,000 | 775 | 900 | — | — | — |
| 60,000 | 1350 | 1500 | — | — | — |
| 70,000 | 2225 | 2450 | — | — | — |
| 80,000 | 3125 | 3350 | — | — | — |
| 90,000 | 4100 | 4350 | — | — | — |
| 100,000 | 5125 | 5400 | — | — | — |
| 110,000 | 6200 | 6500 | — | — | — |
| 120,000 | 7200 | 7800 | — | — | — |
| 130,000 | 8600 | 9150 | 9475 | 9700 | 9850 |
| 0–130,000 | 10150 | 10850 | — | — | — |

TEST XXVI

Included Groove Angle—121 degrees
Number of Rope Turns—Three and One-fourth
Results of this test were as follows:

| Deadline Load $T_1$ (lbs) | Sensor Load $T_2$ (lbs) 1 Min. | 2 Min. | 3 Min. | 4 Min. |
|---|---|---|---|---|
| 40,000 | 0 | 0 | — | — |
| 50,000 | 50 | 50 | — | — |
| 60,000 | 75 | 75 | — | — |
| 70,000 | 75 | 75 | — | — |
| 80,000 | 100 | 100 | — | — |
| 90,000 | 125 | 125 | — | — |
| 100,000 | 200 | 250 | — | — |
| 110,000 | 300 | 400 | — | — |
| 120,000 | 600 | 900 | — | — |
| 130,000 | 1700 | 1850 | 2000 | 2100 |
| 0–130,000 | 2100 | 2450 | 2650 | 2800 |

TEST XXVI

Included Groove Angle—121 degrees
Number of Rope Turns—Two and One-fourth
Results of this test were as follows:

TEST XXVII

Included Groove Angle—121 degrees
Number of Robe Turns—Two and One-fourth
Results of this test were as follows:

| Deadline Load $T_1$ (lbs) | Sensor Load $T_2$ (lbs) 1 Min. | 2 Min. | 3 Min. | 4 Min. |
|---|---|---|---|---|
| 20,000 | 0 | — | — | — |
| 30,000 | 75 | — | — | — |
| 40,000 | 200 | 700 | — | — |
| 50,000 | 1300 | 1400 | — | — |
| 60,000 | 2200 | 2400 | — | — |
| 70,000 | 3000 | 3350 | — | — |
| 80,000 | 4400 | 4600 | — | — |
| 90,000 | 5500 | 5900 | — | — |
| 100,000 | 6750 | 6800 | — | — |
| 110,000 | 8250 | 8900 | — | — |
| 120,000 | 10100 | 10800 | — | — |
| 130,000 | 11900 | 12300 | 12400 | — |
| 0–130,000 | 13000 | 13700 | 13700 | — |

A comparison of the results from the above tests, particularly Tests IX–XXVII, confirms the preferred parameters set forth above. In particular, in Tests IX and X, it was somewhat more difficult to slip and feed the plastic coated rope than in the subsequent tests. With the included angle being greater than 165 degrees, it became much more difficult if not impossible to slip or feed the plastic coated rope in the manner described above as being necessary for proper operation of the cable anchor assembly of the invention.

The more preferred included angle for the groove was in the range of 150 degrees–160 degrees and most preferably about 160 degrees as demonstrated in Tests XII–XVII. In this range, a substantial portion or preferably 100 percent of the rope load could be supported by the drum without reliance upon the clamp.

As the included angle ranged downwardly toward 130 degrees, the remaining load ($T_2$) which is necessarily taken up by the clamp became relatively excessive. Note in particular from Test XXIV that, with three and one-fourth wraps of rope about the drum and with an included angle of about 132 degrees, the load cell load ($T_2$) approached 1000 lbs. which is considered a relative maximum in terms of the present invention. By contrast, Test XXVI also included three and one quarter turns of rope about the drum with an included angle of 121 degrees, resulting in loads ranging unacceptably from above 1000 to almost 3000 lbs.

At the same time, these tests indicate that it is possible to operate with as few as two and one-fourth turns. However, three and one quarter to four and one-fourth turns are preferred and three and one quarter turns are most preferred.

Accordingly, there has been described a preferred cable anchor assembly and method for anchoring plastic coated cable in oil drilling derrick applications and the like. Numerous variations and modifications are believed apparent in addition to those specifically set forth above. Accordingly, the scope of the present invention is defined only by the following appended claims.

What is claimed is:

1. A cable anchor assembly for use in anchoring plastic coated hoisting rope to alternatively carry a load in oil well drilling derricks and the like and also for allowing the plastic coated rope to be selectively slipped or fed through the cable anchor assembly for replacement thereof, comprising a base, a snubbing drum and clamp means mounted on the base, the drum having a spiral groove formed on a cylindrical surface of the drum for receiving the plastic coated rope wound thereabout and for engaging and anchoring the rope, the clamp means being arranged for engaging the rope opposite the drum from the rope load, the spiral groove being formed with an included angle in the range of about 136 to 165 degrees for developing substantial frictional engagement with the plastic coated rope while still permitting selective slippage of the rope in the groove when feeding the rope through the cable anchor assembly, and the groove being formed with at least three turns on the cylindrical drum surface which are engaged by the plastic coated rope, the number of turns being selected for normally supporting most of the rope load whereby the clamp engages the rope with a force preventing damage to the rope, the radius of the plastic coated rope being greater than the radius of the spiral groove whereby a "pinch effect" is produced between the spiral groove and plastic coated rope in order to maintain desired frictional engagement therebetween.

2. The cable anchor assembly of claim 1 wherein the groove is formed with an included angle in the range of from about 150 degrees to about 160 degrees.

3. The cable anchor assembly of claim 2 wherein the groove is formed with an included angle of about 160 degrees.

4. The cable anchor assembly of claim 1 wherein the groove is formed with between three and four turns for engagement with the plastic coated rope about the cylindrical surface of the drum.

5. The cable anchor assembly of claim 1 wherein the groove is formed with about three turns for engagement with the plastic coated rope about the cylindrical surface of the drum for enhanced frictional contact between the rope and drum while also allowing slip and cut replacement of the rope.

6. The cable anchor assembly of claim 5 wherein the groove is formed with an included angle of about 160 degrees.

7. The cable anchor assembly of claim 6 wherein the clamp means comprises a clamp housing fixed relative to the snubbing drum, insert means arranged within the clamp housing for engaging the rope and means for applying clamping force to the rope through the insert means.

8. The cable anchor assembly of claim 7 wherein the insert means is formed with internal grooves for engagement with the plastic coated rope to permit clamping of the rope with reduced clamping force.

9. The cable anchor assembly of claim 1 wherein the clamp means comprises a clamp housing fixed relative to the snubbing drum, insert means arranged within the clamp housing for engaging the plastic coated rope and means for applying clamping force to the rope through the insert means.

10. The cable anchor assembly of claim 9 wherein the insert means is formed with internal grooves for engagement with the rope to permit clamping of the rope with reduced clamping force.

11. The cable anchor assembly of claim 1 wherein the included angle of the groove and the number of groove turns for engagement with the plastic coated rope support approximately 100 percent of the rope load whereby the clamp is normally unloaded and thus provides a safety factor in the cable anchor assembly while minimizing damage to the plastic coated rope.

12. A cable anchor assembly for use in anchoring plastic coated rope to alternatively carry a load in oil well drilling derricks and the like and also to allow the plastic coated rope to be selectively slipped or fed through the cable anchor assembly for replacement thereof, comprising a base, a snubbing drum and clamp means mounted on the base, the drum having a spiral groove formed on a cylindrical surface of the drum for receiving the plastic coated rope wound thereabout and for engaging and anchoring the rope, the clamp means being arranged for engaging the rope opposite the drum from the rope load, the spiral groove being formed with an included angle in the range of from about 136 degrees to about 165 degrees for developing substantial frictional engagement with the plastic coated rope while still permitting selective slippage of the rope in the groove when feeding the rope through the cable anchor assembly, the groove being formed with at least three turns on the cylindrical drum surface which are engaged by the plastic coated rope, and the clamp means comprising a clamp housing fixed relative to the snubbing drum, insert means arranged within the clamp housing for engaging the rope and means for applying clamping force to the rope through the insert means, the radius of the plastic coated rope being greater than the radius of the spiral groove whereby a "pinch effect" is produced between the spiral groove and plastic coated rope in order to maintain desired frictional engagement therebetween.

13. The cable anchor assembly of claim 12 wherein the groove is formed with an included angle of about 150 to 160 degrees.

14. The cable anchor assembly of claim 12 wherein the groove is formed with an included angle of about 160 degrees.

15. The cable anchor assembly of claim 12 wherein the groove is formed with between thread and four turns for engagement with the plastic coated rope about the cylindrical surface of the drum.

16. The cable anchor assembly of claim 12 wherein the groove is formed with about three turns for engagement with the plastic coated rope about the cylindrical surface of the drum for enhanced frictional contact between the rope and drum while also allowing slip and cut replacement of the rope.

17. The cable anchor assembly of claim 12 wherein the insert means is formed with internal grooves for engagement with the plastic coated rope to permit clamping of the rope with reduced clamping force.

18. A method for anchoring plastic coated rope to alternatively carry a load in oil well drilling derricks and the like and also to allow the plastic coated rope to be selectively slipped or fed through the cable anchor assembly for replacement thereof, comprising the steps of mounting a snubbing drum and clamp means on a base structure to resist the rope load, the drum having a spiral groove formed on a cylindrical surface of the drum for receiving the plastic coated rope wound thereabout for engaging and anchoring the rope, the clamp means being arranged for engaging the rope opposite the drum from the rope load, forming the spiral groove with an included angle in the range of 136 to 165 degrees for developing substantial frictional engagement with the plastic coated rope while still permitting selective slippage of the cable in the groove when feeding the rope through the anchor assembly, and forming at least three groove turns which are engaged by the plastic coated rope about the cylindrical surface of the drum, the number of turns being selected for normally supporting most of the rope load whereby the clamp engages the rope with a force to prevent damage to the rope, the radius of the plastic coated rope being greater than the radius of the spiral groove whereby a "pinch effect" is produced between the spiral groove and plastic coated rope in order to maintain desired frictional engagement therebetween.

19. The method of claim 18 wherein the included angle of the groove and the number of groove turns for engagement with the plastic coated rope are selected for normally supporting approximately 100 percent of the rope load whereby the clamp is normally unloaded and thus provides a safety factor in the cable anchor while minimizing damage to the plastic coated rope.

20. The method of claim 18 wherein the groove is formed with an included angle in the range of from about 150 degrees to about 160 degrees.

21. The method of claim 18 wherein the groove is formed with an included angle of about 160 degrees.

22. The method of claim 18 wherein the groove is formed with at least three to four turns for engagement with the plastic coated rope about the cylindrical surface of the drum.

23. The method of claim 18 wherein the groove is formed with about three turns for engagement with the plastic coated rope about the cylindrical surface of the drum for enhanced frictional contact between the rope and drum while allowing slip and cut replacement of the rope.

24. The method of claim 18 wherein the clamp means comprises a clamp housing fixed relative to the snubbing drum, insert means arranged within the clamp housing for engaging the plastic coated rope and means for applying clamping force to the rope through the insert means.

25. The method of claim 24 wherein the insert means is formed with internal grooves for engagement with the plastic coated rope to permit clamping of the rope with reduced clamping force.

* * * * *